US005429096A

United States Patent [19]

Fukasawa et al.

[11] Patent Number: 5,429,096

[45] Date of Patent: Jul. 4, 1995

[54] FUEL EVAPOTRANSPIRATION PREVENTING DEVICE FOR INTERNAL COMBUSTION ENGINES

[75] Inventors: Osamu Fukasawa, Obu; Hiroshi Tamura, Kariya, both of Japan

[73] Assignee: Nippondenso Co., Ltd., Kariya, Japan

[21] Appl. No.: 283,910

[22] Filed: Aug. 4, 1994

[30] Foreign Application Priority Data

Aug. 5, 1993 [JP] Japan ..... 5-194637

[51] Int. Cl.[6] ..... F02M 37/00

[52] U.S. Cl. ..... 123/514; 137/576

[58] Field of Search ..... 123/509, 514; 137/514, 137/576

[56] References Cited

U.S. PATENT DOCUMENTS

| | | | |
|---|---|---|---|
| 4,279,232 | 7/1981 | Schuster et al. | 123/514 |
| 4,459,964 | 7/1984 | Straubel et al. | 123/514 |
| 4,502,450 | 3/1985 | Duprez | 123/514 |
| 4,672,937 | 6/1987 | Fales et al. | 123/509 |
| 4,926,829 | 5/1990 | Tuckey | 123/514 |
| 5,050,567 | 9/1991 | Suzuki | 123/514 |
| 5,253,628 | 10/1993 | Brown | 137/576 |
| 5,263,456 | 11/1993 | Owen-Evans | 123/514 |
| 5,263,458 | 11/1993 | Fujino et al. | 137/574 |

FOREIGN PATENT DOCUMENTS

| | | |
|---|---|---|
| 64-41665 | 3/1989 | Japan . |
| 346219 | 9/1991 | Japan . |

*Primary Examiner*—Henry C. Yuen
*Assistant Examiner*—Thomas N. Moulis
*Attorney, Agent, or Firm*—Cushman Darby & Cushman

[57] ABSTRACT

A fuel tank includes a main tank portion and a sub-tank portion. The returned fuel returned from an internal combustion engine is returned through a return passage to each of the tank portions. The return passage is equipped with a distributing valve for adjusting the volume of the returned fuel to be returned to the main tank portion and the sub-tank portion according to the fuel temperature within the sub-tank portion. For example, when the fuel temperature within the sub-tank portion is lower than boiling point of the fuel, the distributing valve is controlled to return all of the returned fuel to the sub-tank portion, and when the fuel temperature is more than the boiling point of the fuel, the distributing valve is controlled to return the returned fuel to both tanks. Accordingly, it is possible to prevent the evapotranspiration of fuel.

23 Claims, 12 Drawing Sheets

| PM \ Ne | | | |
|---|---|---|---|
| | θ7 | θ5 | θ3 | θ1 |
| | θ8 | θ6 | θ4 | θ2 |

$\theta_1<\theta_2<\theta_3<\theta_4<\theta_5<\theta_6<\theta_7<\theta_8$

FUEL EVAPOTRANSPIRATION PREVENTING DEVICE FOR INTERNAL COMBUSTION ENGINES

BACKGROUND OF THE INVENTION

1. Field of the Invention

The present invention relates to a device for internal combustion engines which prevents evapotranspiration of fuel.

2. Description of Related Art

Generally, a fuel tank for a vehicle or other motorized equipment includes a fuel pump. Furthermore, as described in U.S. Pat. No. 4,672,937, some devices include a sub-tank within a fuel tank for maintaining a sufficient fuel level, even when the level of the fuel tank lowers. Furthermore, a fuel pump disposed in such a sub-tank prevents vapor-lock caused by a lowered fuel level.

The device disclosed in the Japanese Examined Utility Model Publication 3-46219 stores in its sub-tank the fuel of a low volatility returned from the internal combustion engine and sends it to the engine when the temperature is high, so as to prevent a vapor-lock from being caused by the vaporization of fuel in the fuel system.

However, the above-described devices have a problem in that, since excessive fuel of a high temperature (of low volatility) returned from the internal combustion engine is stored in a part of the fuel tank (that is, in a sub-tank), the temperature of that part of the stored fuel becomes higher. If the temperature of the stored fuel returned from the engine exceeds the boiling point of the liquid fuel, the generation of vaporized fuel rapidly increases.

Another problem is that if there is a difference in temperature between the liquid fuels in the main tank and the sub-tank, when the fuel having the lower temperature (in the main tank) drops into fuel having a higher temperature (in the sub-tank) while, for example, the vehicle is cornering, a rapid increase in the generation of vaporized fuel, or a fuel splash, occurs.

The increased generation of vaporized fuel or the fuel splash results in an overflow of a canister used for adsorbing the vaporized fuel, thus releasing vaporized fuel into the surrounding atmosphere. The present invention is intended to solve the problem of unwanted discharge of vaporized fuel by preventing evapotranspiration of fuel.

SUMMARY OF THE INVENTION

Accordingly, the present invention provides a fuel evapotranspiration preventing device for internal combustion engines, comprising a fuel tank having a main tank portion and a sub-tank portion, a return piping for returning excess fuel returned from an internal combustion engine to the main tank portion and the sub-tank portion, a fuel temperature detecting device that detects the fuel temperature of fuel in the sub-tank portion, a distributing valve disposed in the return piping for distributing the excess fuel to the main tank portion and the sub-tank portion, and a distributed volume controlling device that changes the volume of the excess fuel to be distributed by controlling the distributing valve according to the fuel temperature of the sub-tank detected by the fuel temperature detecting means, as illustrated in FIG. 1, for example.

Excess fuel returned from the internal combustion engine goes through the return piping and is returned into the main tank portion and sub-tank portion of the fuel tank. When the excess fuel is returned, the volume of the distributed fuel is changed by the distributing valve which is disposed in the return piping and controlled by the distributed volume controlling means based upon the fuel temperature of fuel in the sub-tank portion.

BRIEF DESCRIPTION OF THE DRAWINGS

Other aspects, advantages, and features of the present invention will be apparent or appreciated by studying the following specification, claims, and appended drawings.

In the accompanying drawings.

DETAILED DESCRIPTION OF THE PREFERRED EMBODIMENTS

The embodiments according to the present invention will now be described with reference to the Figures.

Figure 1:
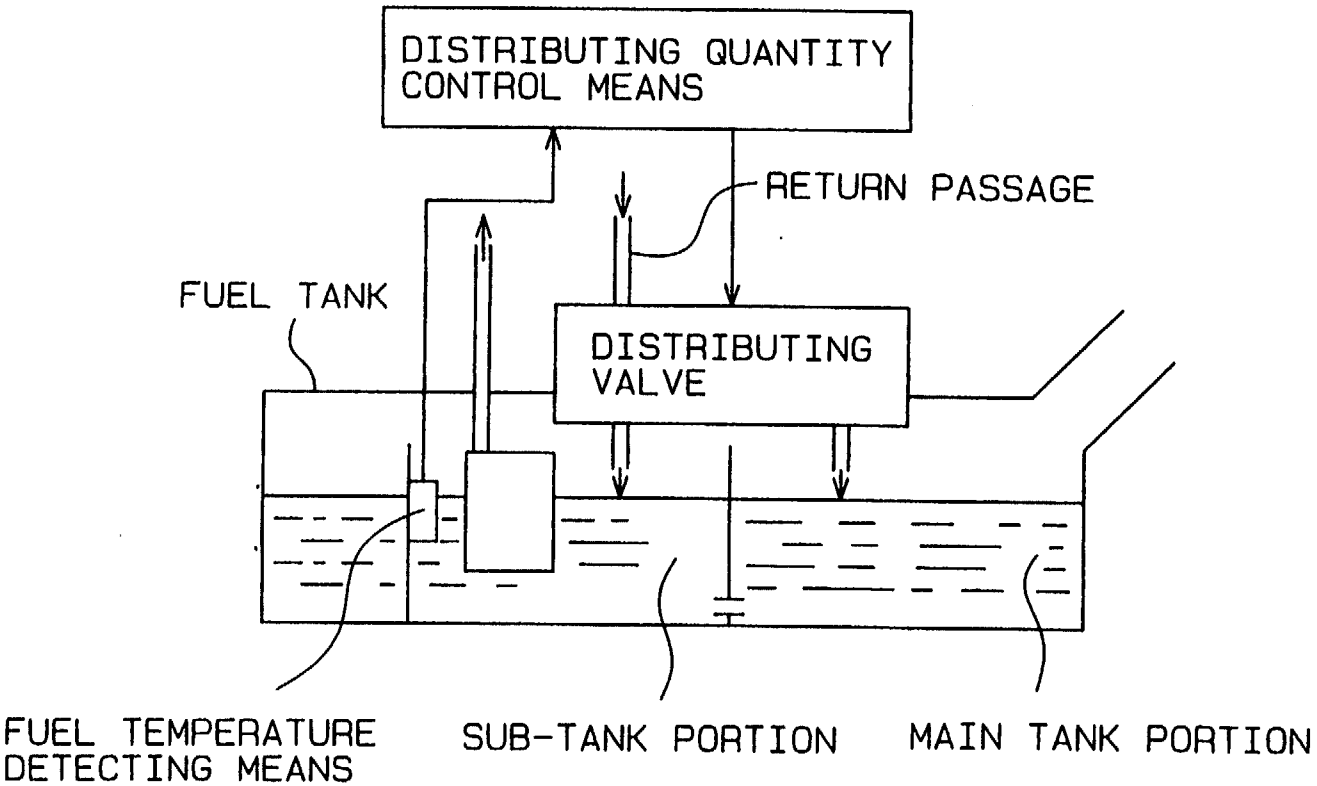
FIG. 1 is a block diagram schematically illustrating elements of the present invention.
Figure 2:
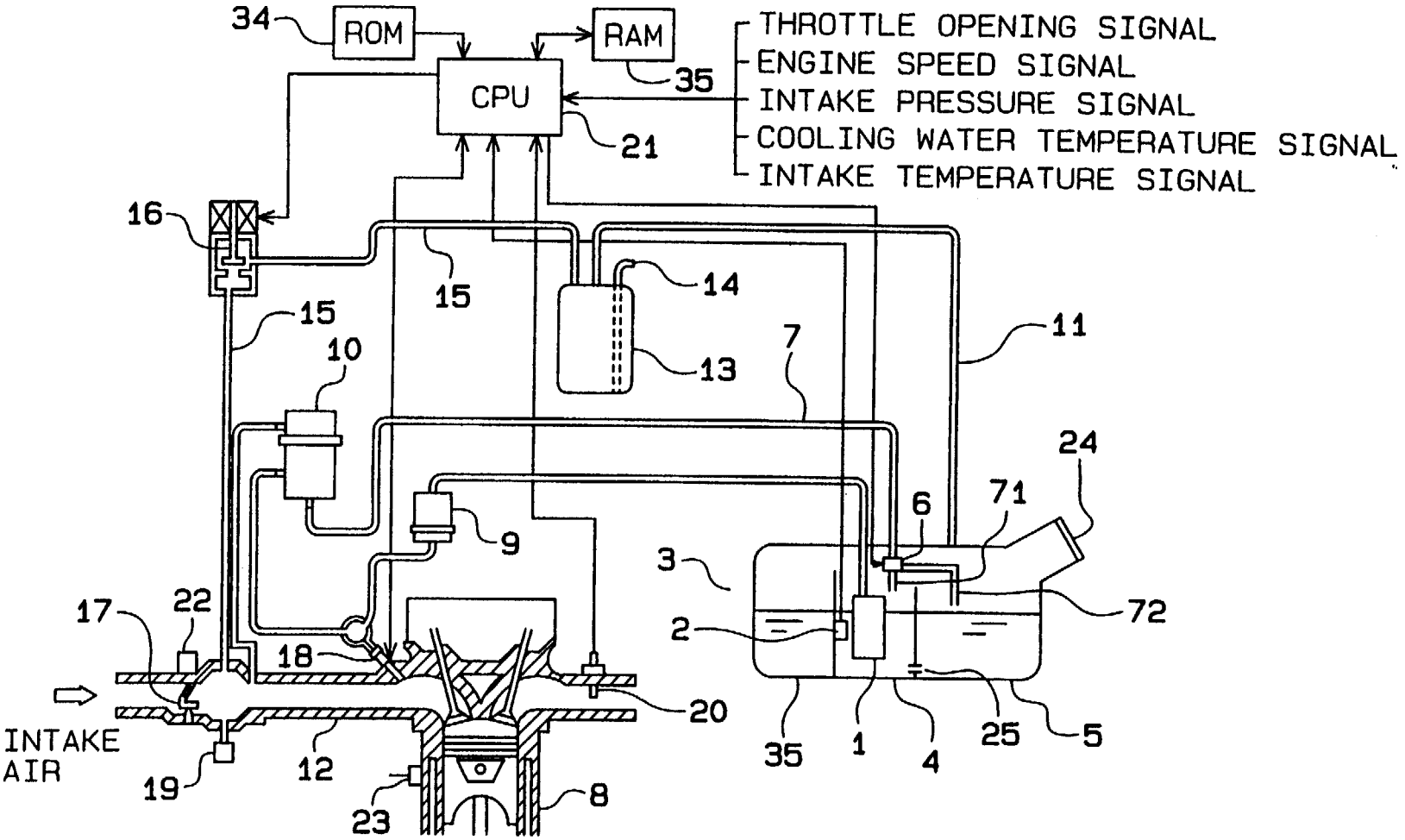
FIG. 2 illustrates first embodiment of the present invention.

FIG. 2 illustrates a fuel evapotranspiration preventing device for use in internal combustion engines. In this figure, a fuel tank 3 includes a main tank 5 and a sub-tank 4. Liquid fuel is supplied to the main tank 5 through a refueling port 24. The main tank 5 communicates with the sub-tank 4 through a communicating port 25 disposed towards the lower sides of tanks 4 and 5. In addition, a fuel temperature sensor 2 is mounted on the inside wall of the sub-tank 4 to detect the fuel temperature of the sub-tank 4.

A fuel pump 1 is disposed in the sub-tank 4 to supply liquid fuel to an internal combustion engine 8. The liquid fuel pumped by the fuel pump 1 goes through a fuel filter 9 and then is supplied through a fuel injection valve 18 to the engine 8.

Furthermore, excess fuel returned from the fuel injection valve 18 returns through a return passage 7 into the fuel tank 3. The return passage 7 comprises a main passage 72 for returning the returned fuel to the main tank 5 and a sub-passage 71 for returning the returned fuel to the sub-tank 4. The returned fuel entering passages 71 and 72 is regulated by a distributing valve 6. The sub-passage 71 is disposed so as to return the returned fuel through an opening above the sub-tank 4, while the main passage 72 is disposed so as to return the returned fuel through an opening above the main tank 5. In addition, in the return passage 7 a pressure regulator 10 is provided to maintain the fuel pressure at a given differential pressure according to the intake negative pressure of the engine 8. Furthermore, the vaporized fuel generated in the fuel tank 3 is adsorbed by a canister 13 through a purge tube 11 and then purged through a discharge passage 15 and a purge control valve 16 into an intake tube 12.

A CPU 21 accepts a throttle opening signal from a throttle sensor 22 that detects the opening of a throttle valve 17, an engine speed signal from an engine speed sensor (not shown) detecting the number of revolutions of the engine 8, an intake pressure signal from an intake pressure sensor 19 that detects the pressure of the intake air passing through the throttle valve 17 (an intake air volume signal from an intake air volume sensor may be used instead), a coolant temperature signal from a coolant temperature sensor 23 that detects the temperature of the engine coolant, and an intake air temperature signal from an intake air temperature sensor (not shown) detecting the temperature of the intake air. CPU 21 further receives information from ROM 34 and sends information to and receives information from RAM 35.

A distributing valve (solenoid valve) 6, which distributes excess fuel into the main tank 5 and the sub-tank 4, is disposed at the exit of the return passage 7 leading to the fuel tank 3.

Figure 3D:
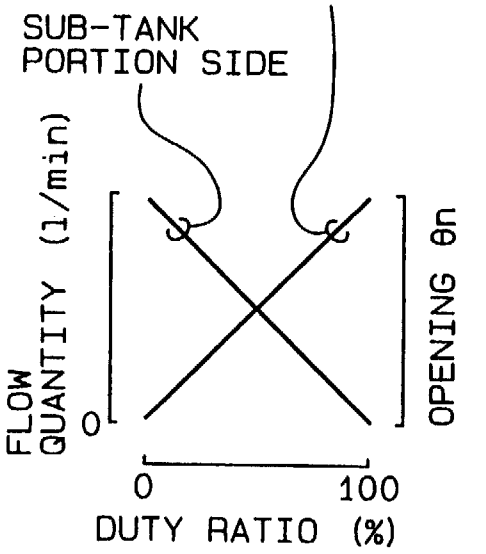
FIG. 3D illustrates an operational characteristic diagram of the distributing valve.
Figures 3A, 3B, 3C:
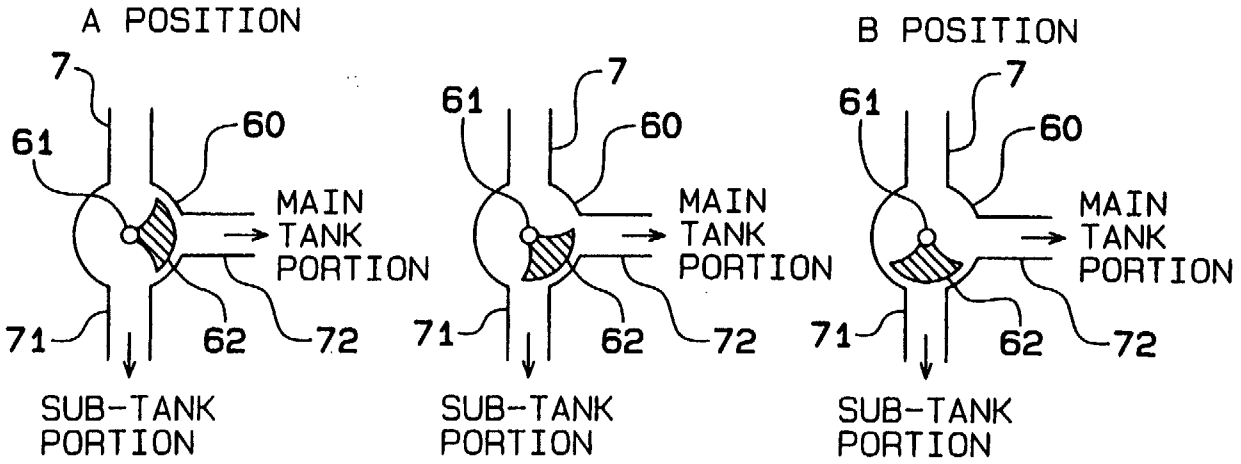
FIGS. 3A–3C depict the structure of the distributing valve of the first embodiment.

The distributing valve 6 has such a structure as illustrated in FIGS. 3A-3C. As can be seen, the return passage 7 communicates with the sub-passage 71 through a valve chest 60, and the main passage 72 is arranged perpendicular to these passages. The main passage 72 also communicates with the return passage 7 and the sub-passage 71 through the valve chest 60. The valve chest 60 includes a shaft 61 of which an end is connected to a rotary actuator (not shown), and a valve disc 62 fixed to the shaft.

The valve disc 62 stays in position A shown in FIG. 3A when no driving current is flowing through the rotary actuator. At this time, all of the returned fuel is returned to the sub-tank 4. When a current starts flowing through the rotary actuator, the shaft 61 turns, and thus the valve disc 62 turns in the direction of the sub-passage 71, as shown in FIG. 3B. As shown in FIG. 3D, the position of the valve disc at this time depends on the duty ratio of the current flowing through the rotary actuator. Finally, the valve disc turns and moves to, at the maximum, position B shown in FIG. Furthermore, the duty ratio is controlled by the CPU 21 according to the fuel temperature of the fuel in the sub-tank 4.

If, for example, the fuel temperature of the sub-tank 4 is lower than a given temperature TO (e.g., a value near the boiling point (60° C.) of a liquid fuel (gasoline)), the CPU 21 sets to 0% the duty ratio of the exciting current flowing through the rotary actuator for driving the distributing valve 6 and sets the valve disc to position A by which the returned fuel is supplied only to the sub-tank 4. When the fuel temperature of the sub-tank 4 becomes equal to or higher than a given temperature, the CPU 21 increases the duty ratio of the exciting current to lower the fuel temperature within the sub-tank 4 and opens the distributing valve 6 in the direction of position B, as shown in FIG. 3B, for example. FIG. 3D shows the characteristics of the relationship between the duty ratio and the valve opening. As the duty ratio increases the valve opening leading to the sub-tank 4 becomes smaller and the valve opening leading to the main tank 5 becomes larger.

FIG. 4 through FIG. 6, FIG. 8, FIG. 9, FIG. 11 and FIG. 13 are flow charts, each showing the process for controlling the distributing valve 6 by the CPU 21. These flow charts, which are interrupt programs executed for each specified period after the engine switch is turned on, depict proper control of the distributing valve 6, with the control always being based on the latest information. Descriptions will now be given referring to these flow charts.

Figure 4:
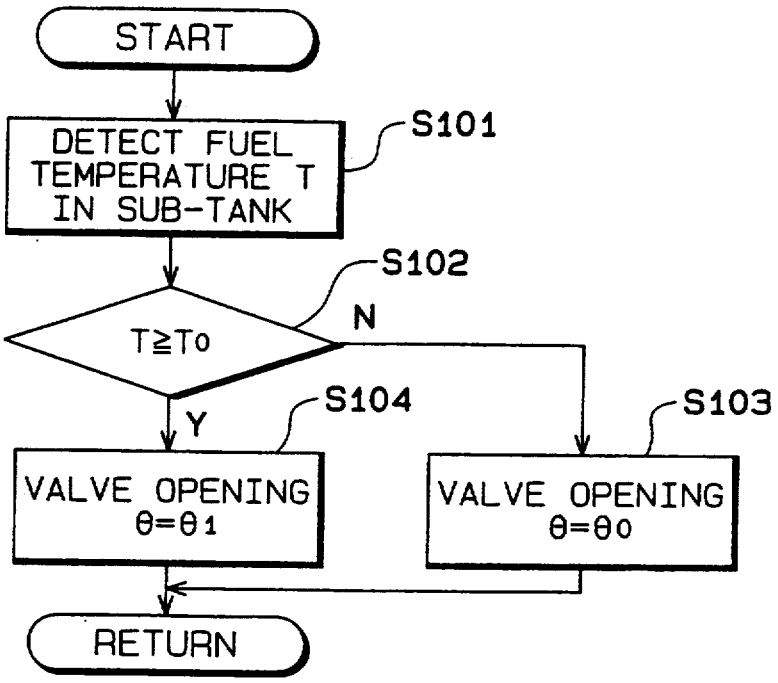
FIG. 4 is a flow chart according to the first embodiment executed by the CPU.

The first embodiment of the process for controlling the distributing valve 6 by the CPU 21 will now be described with reference to FIG. 4. In this embodiment, when the sub-tank's fuel temperature T is equal to or higher than a given temperature T0 (60° C., for instance)(that is, $T \geqq 0$), a process is executed to set the opening of the distributing valve 6 to a given opening $\theta 1$.

First, when the engine switch is turned on, the sub-tank's fuel temperature T is detected in step S101. Next, the temperature is compared to a given temperature T0 in step S102. If the temperature T is equal to or higher than the given temperature T0, the process will proceed to step S104, or if lower than a given temperature T0, the process will proceed to step S103.

In step S104, the opening of the distributing valve 6 is set to a given opening $\theta 1$ to distribute the returned fuel into the main tank 5 and the sub-tank 4, and then the routine is completed. In step S103, the opening of the distributing valve 6 is set to $\theta 0$, which is such a degree of opening as returns all of the returned fuel to the sub-tank 4. When this process is completed, the routine finishes.

If the sub-tank's fuel temperature becomes lower than a given temperature T0 as a result of step S104 by which the distributing valve opening is set to $\theta 1$, the opening of the distributing valve 6 will be set back to $\theta 0$ by step S103 when the routine is executed after the specified cycle has been completed.

By executing the above process, the returned fuel whose temperature becomes higher because of the heat generated in the internal combustion engine is returned into the sub-tank 4, and as the fuel temperature of the sub-tank 4 gets higher, part of the returned fuel can be returned to the main tank 5. This results in reducing the volume of the returned fuel returned to the sub-tank 4, and thus, effectively lowering the fuel temperature of the fuel in the sub-tank 4. Accordingly, the generation of vaporized fuel can be controlled even if the fuel temperature within the sub-tank 4 exceeds the boiling point of the fuel. Moreover, the difference in fuel temperature between the main tank 5 and the sub-tank 4 becomes smaller since part of the returned fuel is also returned into the main tank 5. Accordingly, a fuel splash, which is caused by the fuel of a lower temperature contained in the main tank 5 dropping through the opening above the sub-tank 4 into the sub-tank 4 storing the fuel with a higher temperature when, for example, the vehicle is cornering, can be controlled.

In this embodiment, the fuel temperature sensor 2 corresponds to and functions as a fuel temperature detecting means, while the steps S102, S103 and S104 correspond to the functioning of the distributed volume controlling means.

Figure 5:
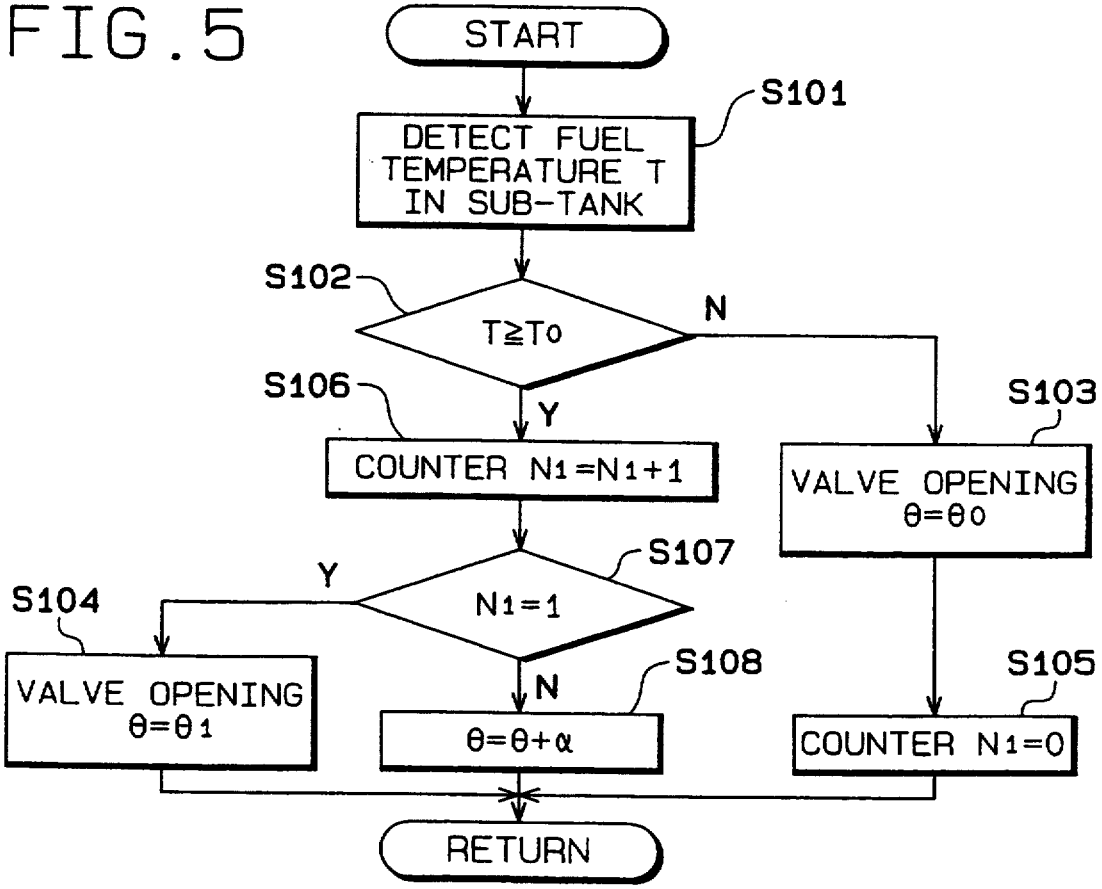
FIG. 5 is a flow chart according to the second embodiment executed by the CPU.

Next, the second embodiment of the process for controlling the distributing valve 6 will now be described referring to FIG. 5. Any step in which the same process as that shown in FIG. 4 is executed has the same step number, and its description will be omitted. In this embodiment, when T is equal to or higher than T0 ($T \geqq T0$) the valve opening is initially set to a given opening $\theta 1$, and then, if the fuel temperature T does not fall below a given temperature T0, a step will be executed so that the valve opening will be larger (or, the valve disc will be moved in the direction shown as position B).

When the engine switch is turned on, the process of steps S101 and S102 is executed. In step S102, when the temperature is equal to or higher than a given temperature T0, the process will proceed to step S106, and the number of times the routine is executed is counted by the first counter N1. In step S107, it is judged whether the number on the counter N1 is "1". If it is "1" step S104 follows, and if it is not "1" step S108 follows. In step S104, the valve opening is set to $\theta 1$ as mentioned above, and then the routine finishes. In step S108, the valve opening of the distributing valve 6 is set to such an opening by adding a given opening $\alpha$ to the previous opening $\theta$, and then the routine finishes.

If it is judged in step S102 that the temperature is lower than a given temperature T0, the process will proceed to step S103, and the valve opening is set to $\theta 0$. In the following step S106, the number on the first counter N1 is reset, and then the routine finishes.

By executing the above process, when the fuel temperature of the sub-tank 4 does not fall below a given value T0, the opening of the distributing valve 6 is controlled so that the ratio of the returned fuel to be returned to the main tank 5 will be increased each time the routine is executed. Accordingly, since the ratio of returned fuel of a higher temperature to be returned into the sub-tank 4 decreases, the fuel temperature of the sub-tank is lowered quicker, and the generation of vaporized fuel can be controlled better.

The third embodiment of the process for controlling the distributing valve 6 will now be described with reference to FIG. 6. Any step in which the same process as that shown in the above embodiments is executed has the same step number, and its description will be omitted. In this embodiment, when T is equal to or larger than T0 ($T \geqq 0$), a process is executed so that the opening of the distributing valve 6 will be $\theta n$ as determined by the engine speed Ne at that time and by the intake air tube's pressure PM (the opening $\theta$ is, according to this embodiment, a valve opening that allows 25% of the returned fuel to be returned to the main tank 5 and 75% thereof to be returned to the sub-tank 4 all the time).

When the engine switch is turned on, the processes of steps S101 and S102 are executed. In step S102, if the temperature is lower than a given temperature T0, the process will proceed to step S103, and the valve opening is set to $\theta 0$ before completing the routine. If the temperature is equal to or higher than a given temperature T0, the process will proceed to step S109.

In step S109, the engine speed Ne is read, and then step S110 follows. In step S110, the intake air tube's pressure PM is read. In step 111, the valve opening $\theta n$ is read out of the valve opening map shown in FIG. 7 according to the engine speed Ne and the intake air tube's pressure PM read in steps S109 and S110. Then, the opening of the distributing valve 6 is set to $\theta n$ to distribute the returned fuel into the main tank 5 and the sub-tank 4, before completing the routine.

Figures 6, 7:
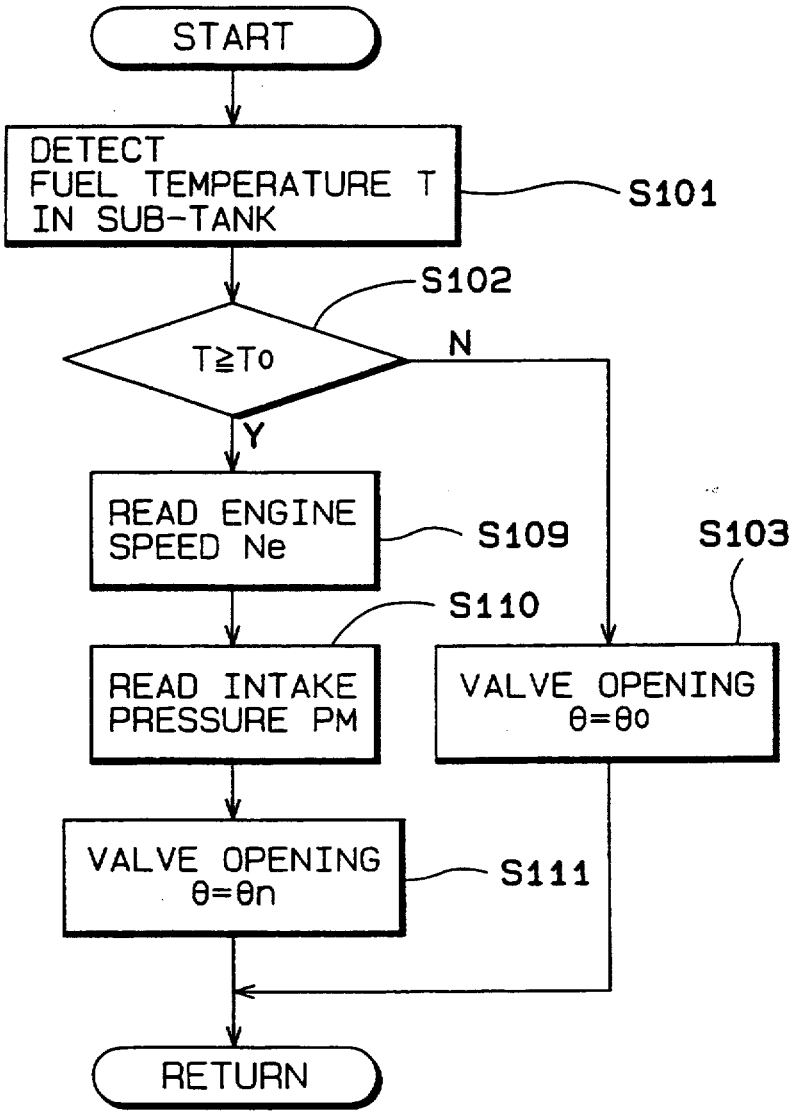
FIG. 6 is a flow chart according to the third embodiment executed by the CPU.
FIG. 7 is a map showing the relationship among the intake air tube's pressure, the engine speed, and the valve opening which are stored in the ROM according to the third embodiment.

In the map shown in FIG. 7, the opening $\theta n$ is in such an order that $\theta 1 < \theta 2 < \ldots < \theta 7 < \theta 8$. In a highly loaded condition, where both the engine speed Ne and the intake air tube's pressure PM are high, the amount of the returned fuel decreases due to large fuel consumption. On the other hand, in an idling condition, where both the engine speed and the intake air tube's pressure are low, the amount of the returned fuel increases due to small fuel consumption. Accordingly, even if the volume of the returned fuel changes, the valve opening is controlled to make the distribution ratio constant. Namely, the opening $\theta n$ is, according to this embodiment, such a valve opening so that the distribution ratio is kept constant even if the volume of the returned fuel changes.

By executing the above process, the returned fuel can be continuously returned to the sub-tank 4 and the main tank 5 at a constant ratio even though the volume of the returned fuel changes as the engine speed Ne and/or the intake air tube's pressure PM changes.

Figure 8A:
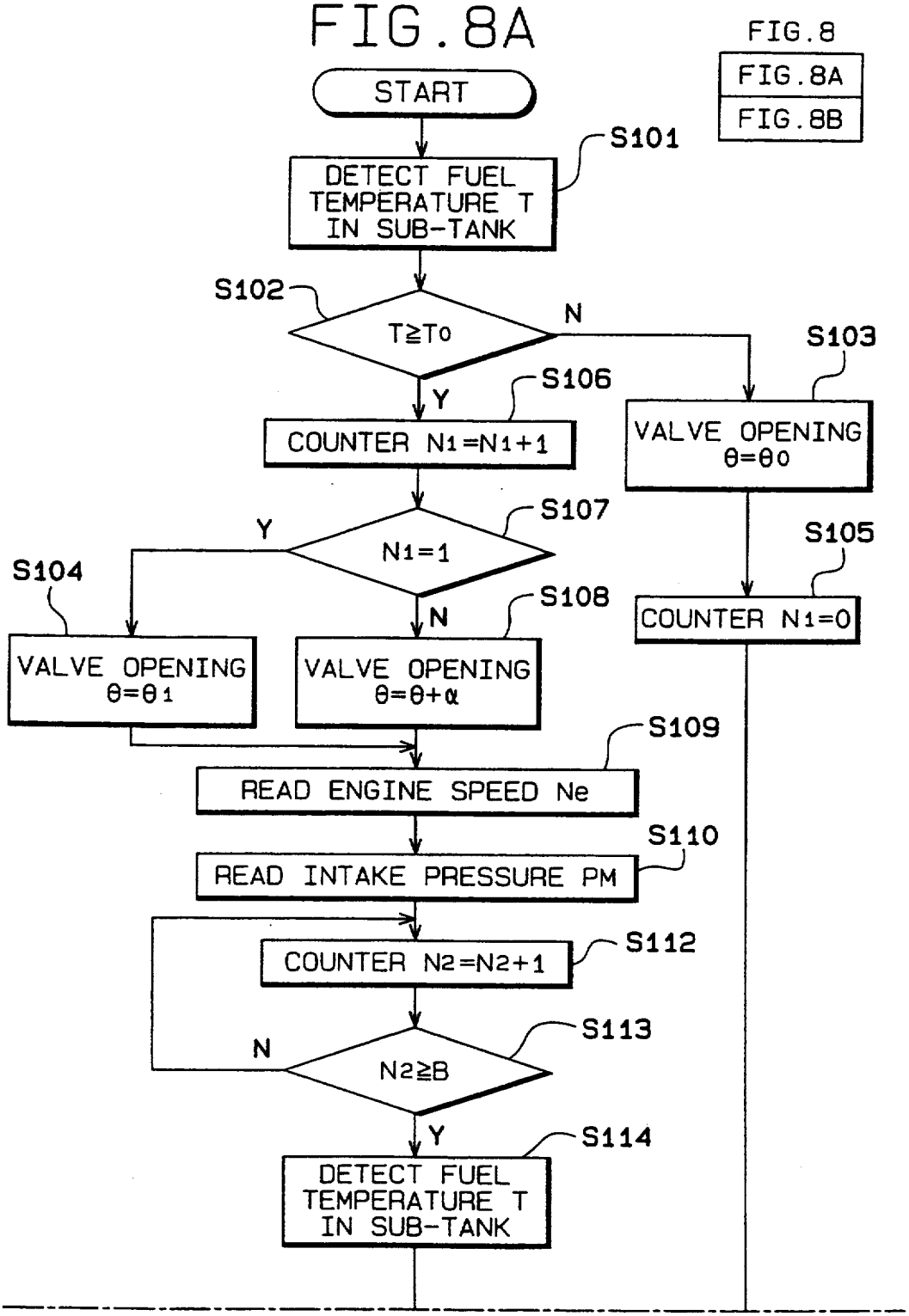
FIGS. 8A–B depict a flow chart according to the fourth embodiment executed by the CPU.
Figure 8B:
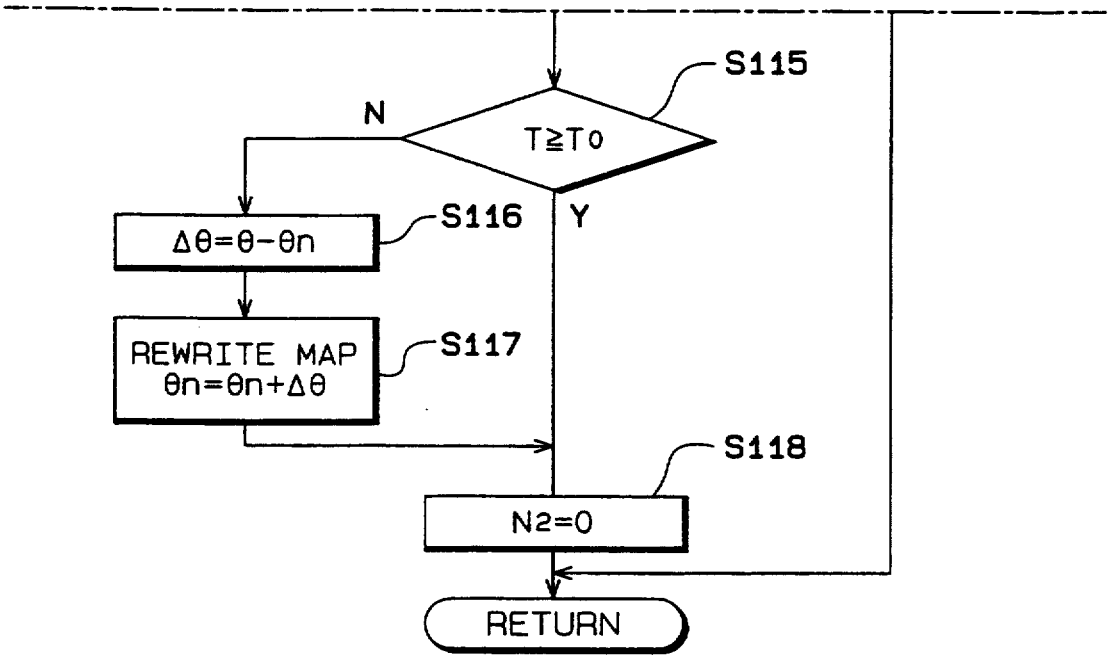

The fourth embodiment of the process for controlling the distributing valve 6 will now be described with reference to FIGS. 8A and B. Any step in which the same process as that in the above embodiments is executed has the same step number, and its description is omitted. This embodiment is to execute a process for correcting the valve opening map and is applied in combination with the third embodiment, for example. This flow chart is put into practice once the engine switch is turned on and until a corrective process is executed.

When the engine switch is turned on, the processes from steps S101 through S110 are executed. Namely, the fuel temperature of the sub-tank 4 is detected, and if the fuel temperature T is lower than a given temperature T0, the opening of the distributing valve 6 is set to $\theta 0$, and the first counter N1 will be reset before completing the routine. On the other hand, if the fuel temperature T is equal to or higher than the given temperature T0, the counting number on the first counter N1 will be incremented by one. Then, if the counting number on the first counter N1 is "1", the opening of the distributing valve 6 is set to $\theta 1$, and if the value of the counter N1 is not "1", the opening will be set to such an opening as is larger than the previous opening by $\alpha$. Also, the engine speed Ne and the intake air tube's pressure PM are read, and then step S112 follows.

In step S112, the counting number on the second counter N2 is incremented by one. In the following step S113, it is determined whether the number on the second counter N2 is equal to or larger than a given number B. If it is smaller than a given number B, the process will go back to step S113. When it becomes equal to or larger than a given number B, the process will proceed to step S114. Namely, in steps S112 and S113, the process will not proceed to the following step until a given time has passed, thus allowing the fuel temperature of the sub-tank 4 to be stabilized.

In step S114, the fuel temperature of the sub-tank 4 is detected again. In step S115, the temperature is compared again to a given temperature T0. If it is equal to or higher than a given temperature T0 step S118 follows, or if lower than a given temperature T0, step S116 follows.

In step S116, the deviation $\Delta\theta$ of the present opening $\theta$ from the valve opening map value $\theta n$ under the present operating condition is calculated. In step S117, the valve opening map value $\theta n$ under the present condition shown in FIG. 7 is rewritten based on the deviation $\Delta\theta$. In step S118, the counting number N2 on the second counter is reset, and then the routine finishes.

Since this function allows the difference in characteristics among the solid matters in different internal combustion engines to be corrected, increases in fuel temperature of the sub-tank 4 can be controlled more precisely.

Figure 9:
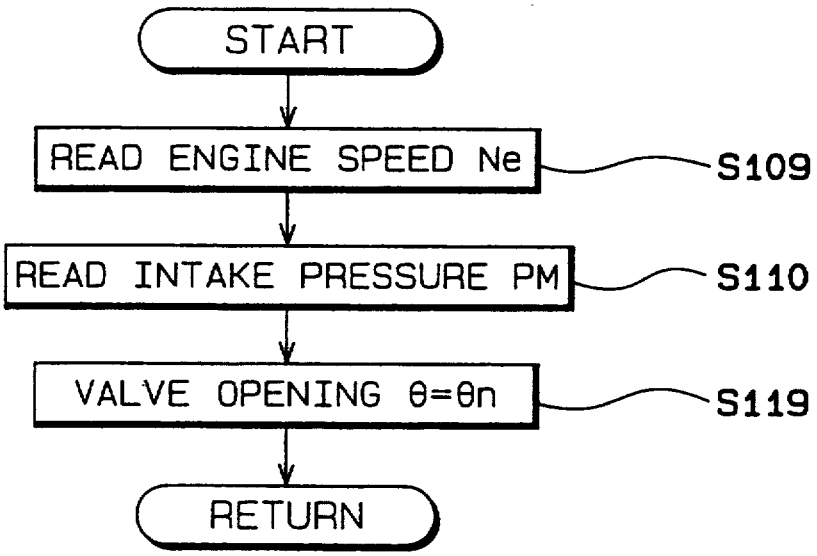
FIG. 9 is a flow chart according to the fifth embodiment executed by the CPU.

The fifth embodiment of the process-for controlling the distributing valve 6 will now be described referring to FIG. 9. Any step in which the same process as that shown in the above embodiments is executed has the same step number. In this embodiment, a process is executed to set the opening $\theta n$ of the distributing valve 6 according to the engine speed Ne and the intake air tube's pressure PM, without directly detecting the fuel temperature of the sub-tank 4.

Figure 10:
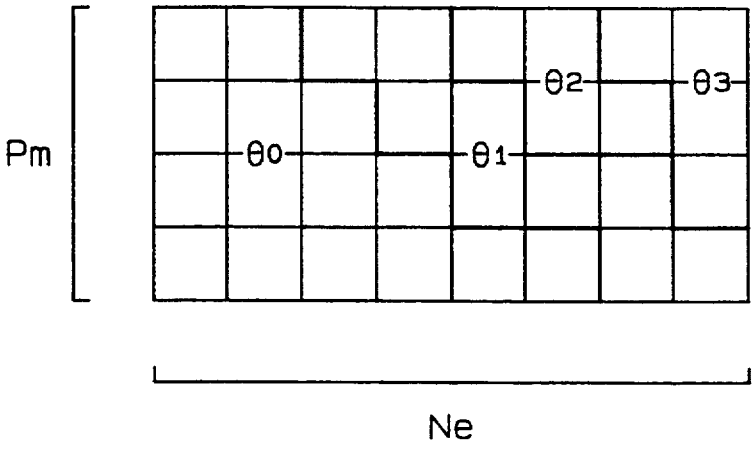
FIG. 10 is a map showing the relationship among the intake air tube's pressure, the engine speed, and the valve opening which are stored in the ROM according to the fifth embodiment.

When the engine switch is turned on, the engine speed Ne is read in step S109. Subsequently, the intake air tube's pressure PM is read in step S110. In step S119, valve opening $\theta n$ is read out of the map shown in FIG. 10 according to the engine speed Ne and the intake air tube's pressure PM read in steps S108 and S109 respectively. This map has been prepared based on the relationship between the operating condition (the engine speed Ne and the intake air tube's pressure PM) calculated by experimental data, and the fuel temperature of the returned fuel, etc. Then, the opening of the distributing valve 6 is set to a corresponding $\theta n$, before completing the routine.

By executing the above process, the effect described in the third embodiment can be obtained without a need for fuel temperature sensor 2, as the temperature of the returned fuel is predicted from the operating condition based on the map prepared in accordance with experimental results, etc., so as to control the opening of the distributing valve 6 so that the fuel temperature of the sub-tank 4 will not exceed a given value.

Figure 11:
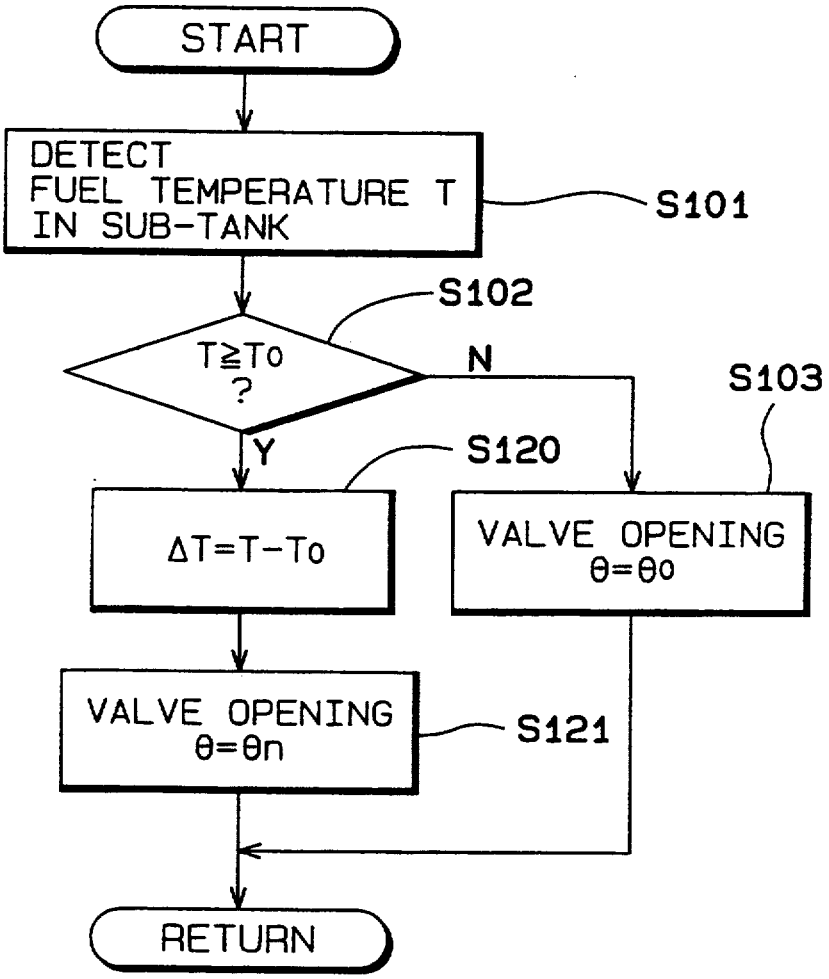
FIG. 11 is a flow chart according to the sixth embodiment executed by the CPU.

The sixth embodiment of the present invention will now be described with reference to the flow chart shown in FIG. 11. Any step in which the same process as that shown in the earlier embodiments is executed has the same step number, and its description is omitted. In this embodiment, a process is executed to set the opening of the distributing valve 6 according to the difference between the sub-tank's fuel temperature T and a given temperature T0.

If it is determined in steps S101 and S102 that the detected fuel temperature T in the sub-tank is equal to or higher than T0 ($T \geqq 0$), the value $\Delta T$ is calculated in step S120. The value $\Delta T$ is calculated in accordance with the following equation.

$$\Delta T = T - T0$$

Figure 12:
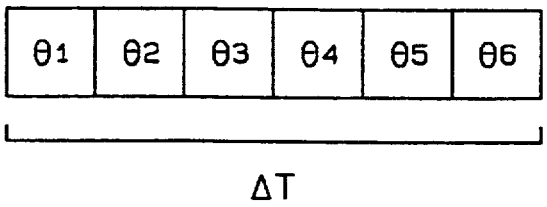
FIG. 12 is a map showing the relationship among the intake air tube's pressure, the engine speed, and the valve opening which are stored in the ROM according to the sixth embodiment.

In step S121, a valve opening $\theta n$ corresponding to the $\Delta T$ is read out of the map shown in FIG. 12, and an opening control is executed against the distributing valve 6 for such an opening.

By executing the above process, the distribution ratio of the returned fuel can be controlled according to the fuel temperature within the sub-tank.

Figure 13:
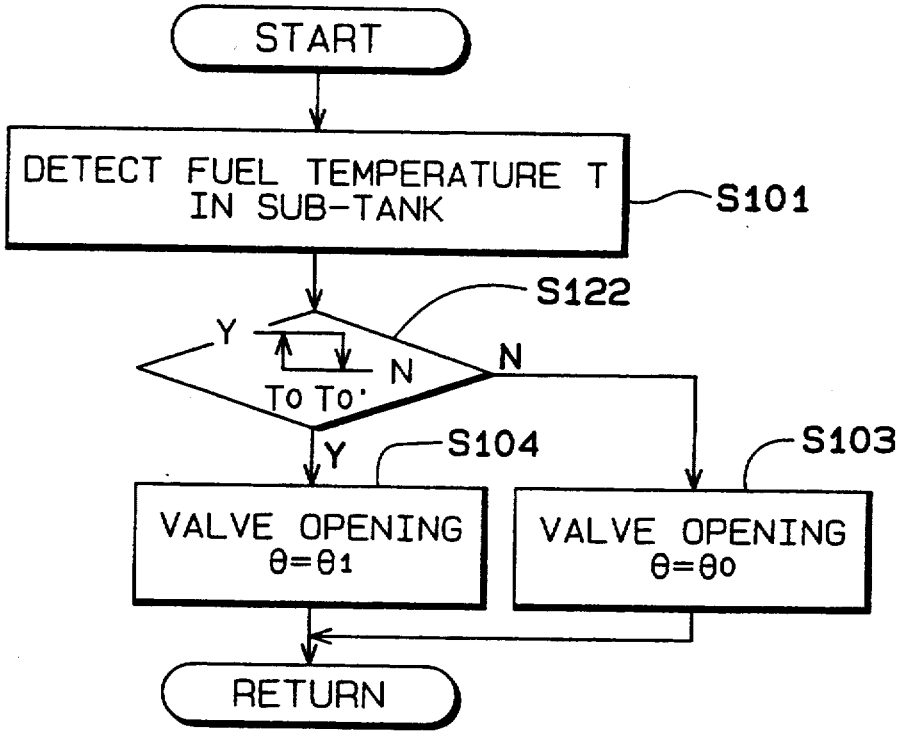
FIG. 13 is a flow chart according to the seventh embodiment executed by the CPU.

The seventh embodiment of the present invention will now be described referring to the flow chart shown in FIG. 13. Any step in which the same process as that shown in the first embodiment is executed has the same step number, and its description will be omitted. In this embodiment, hysteresis properties are added to the conditions for controlling the valve opening.

In step S101, the fuel temperature T of the sub-tank is detected. Step S122 is followed by steps S103 and S104, respectively, according to the hysteresis properties by which the valve opening is controlled from $\theta 0$ to $\theta 1$ when the sub-tank's fuel temperature T is T0, or from $\theta 1$ to $\theta 0$ when the same is T0'. In step S103, the valve opening is set to $\theta 0$ and then the routine finishes. In step S104, the valve opening is set to $\theta 1$ and then the routine finishes.

By executing this process, even if the valve opening is set back to $\theta 0$ at a given temperature T0, the temperature T will not immediately become equal to or higher than T0 ($T \geqq 0$) again, and thus the number of times the valve opening is actuated can be reduced.

The distributing valve 6 illustrated in FIG. 3 is employed in the above embodiments. Other valves such as those illustrated in FIG. 14, FIGS. 15A-15C, and FIG. 16 may be also employed.

Figure 14:
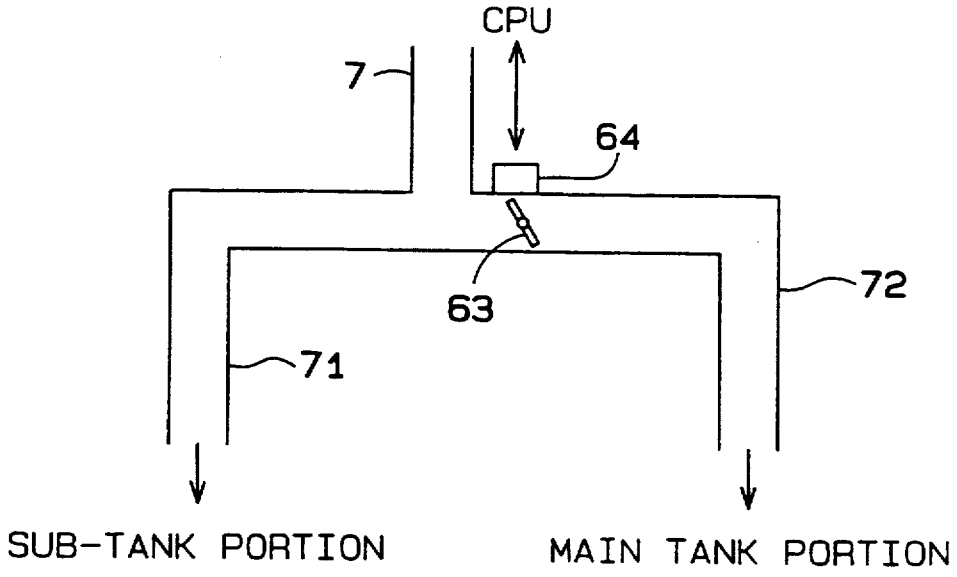
FIG. 14 shows a modification of the distributing valve.

For example, in FIG. 14, a volume-adjusting valve 63 is arranged in the main passage 72 for passing the returned fuel back to the main tank. The volume-adjusting valve 63 is driven by a step motor 64. Further, the step motor 64 is controlled by the CPU 21. The CPU 21 controls the step motor 64 so that, when the fuel temperature T of the sub-tank 4 is lower than a given temperature T0, the volume-adjusting valve 63 will be completely closed so as to supply all of the returned fuel to the sub-tank 4 through the return passage 7 and the sub-passage 71. When the combustion temperature exceeds a given temperature T0, the CPU 21 will determine the opening of the volume adjusting valve 63 according to the set conditions by controlling the step motor 64.

Figure 15A:
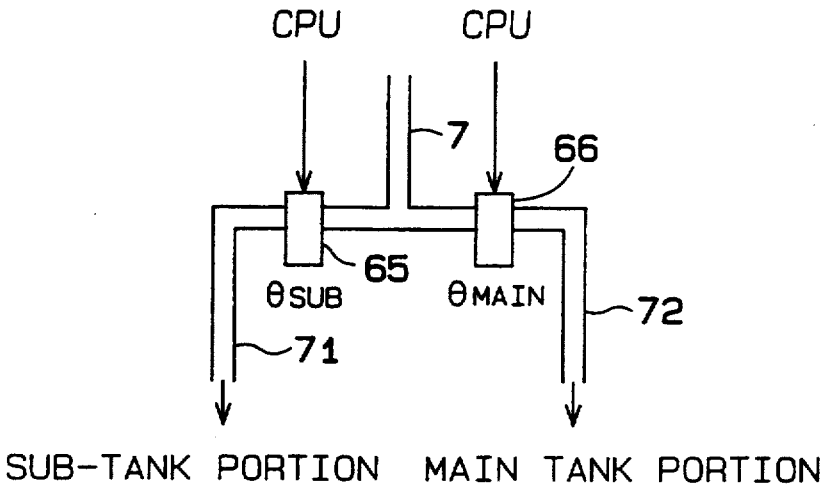
FIGS. 15A to 15C illustrate another modification of the distributing valve, FIG. 15A illustrating system configuration, FIG. 15B depicting a sectional view of the structure of the distributing valve, and FIG. 15C being an operational characteristic diagram.
Figure 15B:
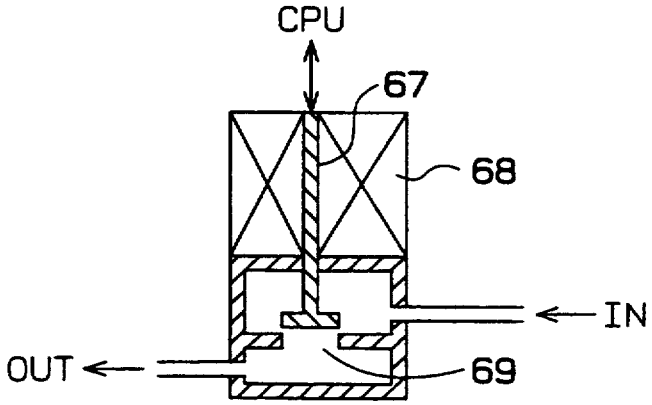
Figure 15C:
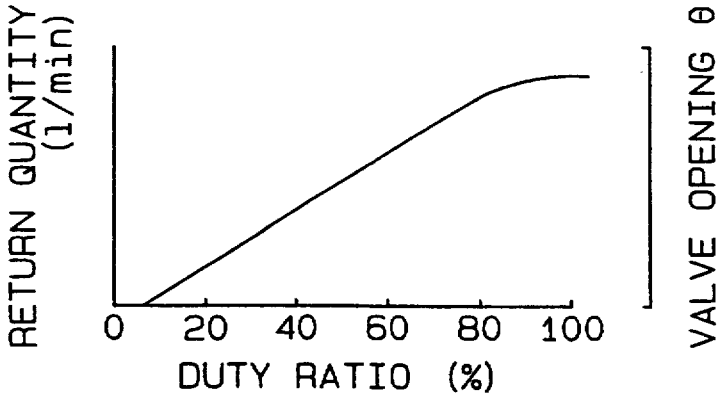

FIG. 15A shows an arrangement that the return passage 7 communicates with the sub-passage 71 through the sub side valve 65 and that the return passage 7 communicates with the main passage 72 through the main side valve 66. FIG. 15B is a sectional view of the structure of either of the valves 65 or 66. A valve disc 67 opens and/or closes a valve port 69 by an exciting current passed through a coil 68. The amount of current passed through the coil 68 is duty-controlled by the CPU 21. Either of a high frequency and a low frequency may be applied to drive the valve disc 67. FIG. 15C is a characteristic diagram illustrating the relationship between the duty ratio and the valve opening. As can be seen from the diagram, as the duty ratio increases, the valve opening becomes larger.

The CPU 21 controls the duty ratio between the sub-side valve 65 and the main side valve 66 to provide such a valve opening ($\theta 0$) so that all of the returned fuel is directed to the sub-tank 4 when the fuel temperature within the sub-tank 4 is lower than T0. When the fuel temperature within the sub-tank 4 becomes equal to or higher than T0, the opening of both valves will be controlled according to the process described above.

In FIG. 15A, for example, when the sub-side valve 65 is opened and the main side valve 66 is completely closed (that is, in the condition where the duty ratio is 0%) as shown in FIG. 15C, all of the returned fuel can be returned to the sub-tank 4. When both the main side valve 66 is open and the sub-side valve 65 is open, the returned fuel can be distributed to both the main tank 5 and the sub-tank 4. The distribution ratio can be controlled by the duty ratio, that is, by varying the amount of current passing through the coil of the valve 65 and that of the valve 66. Further, if the sub-side valve 65 is completely closed, all of the returned fuel can be directed to the main tank 5.

Figure 16:
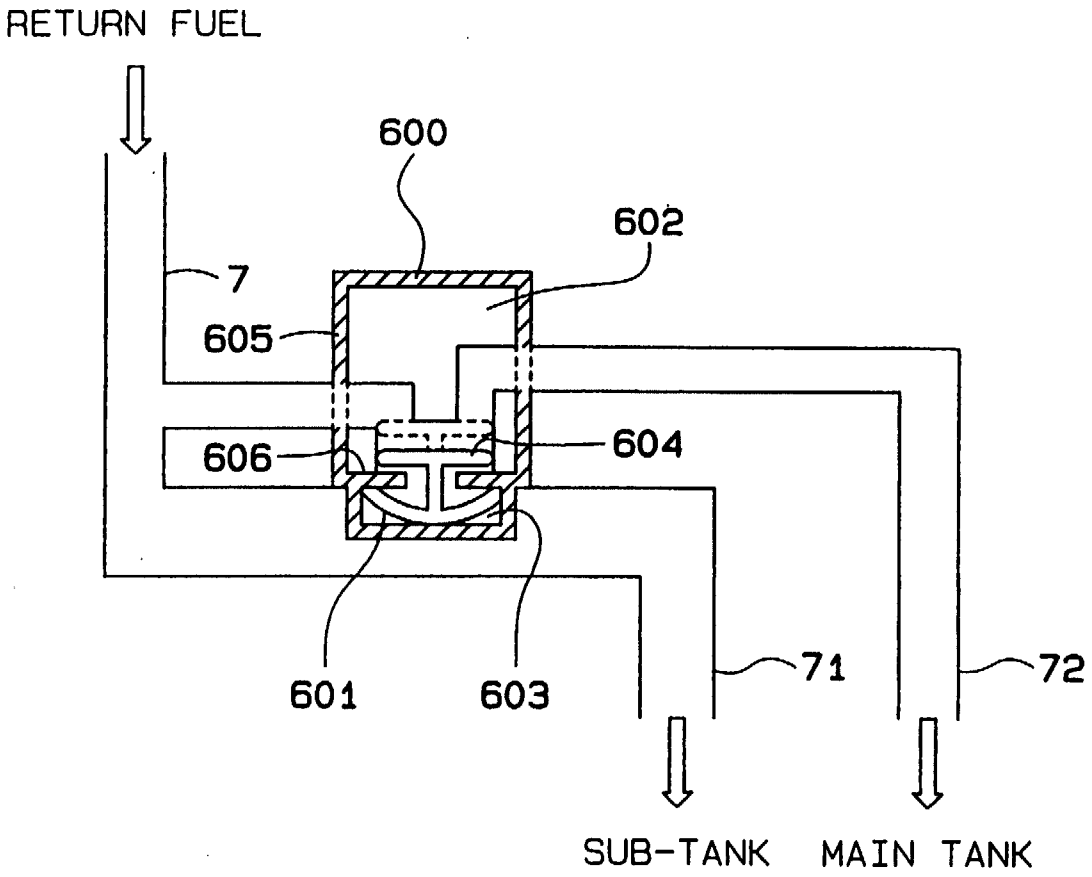
FIG. 16 illustrates still another modification of a distributing valve.

Furthermore, a bimetal valve 600 may be disposed as the distributing valve 6. In this case, as shown in FIG. 16, a housing 605 of the bimetal valve 600 comprises a valve chest 602 including the main passage 72 and a valve disc 604, and a bimetal chest 603 including a bimetal member 601. The valve chest 602 and the bimetal chest 603 are divided by a partition 606. The bimetal chest 603 is arranged in the sub-passage 71 so that the fuel temperature of the returned fuel flowing through the sub-passage 71 is transferred to the bimetal member 601.

Descriptions will now be given to the operation of the bimetal valve 600 with the above structure. When the temperature of the returned fuel flowing through the sub-passage 71 reaches a given temperature (57° C., for instance), the bimetal member 601 changes its figure from that shown by the dotted lines to that shown by the solid lines in FIG. 16. By such a change, the valve disc 604 is pulled toward the bimetal member 601, and thus the main passage 72 communicates with the return passage 7. It is desirable to set the temperature at which the main passage 72 communicates with the return passage 7 to approximately 60° C., which is the boiling point of gasoline.

The above structure helps reduce the load on CPU 21. In addition, since the returned fuel is supplied continuously to the sub-tank 4, even when the distributing valve 6 fails, an insufficient pressure adjustment due to increases in the fuel temperature of the return piping can be avoided.

According to the present invention which adopts the above structure, excess fuel returned from the internal combustion engine is returned through the return piping to the main tank and sub-tank of the fuel tank. The volume of fuel to be distributed to these tanks in such a way is controlled by the distributed volume controlling means according to the fuel temperature of the sub-tank.

Since the fuel temperature of the sub-tank can be thus maintained at an appropriate temperature, the discharge of vaporized fuel into the atmosphere is prevented even though the temperature of the fuel in the sub-tank has increased.

The present invention has been described in connection with what are presently considered the preferred embodiments of the present invention. However, the present invention is not intended to be limited to the disclosed embodiments. Rather, the invention is meant to include all modifications and alternate arrangements included within the spirit and scope of the appended claims.

What is claimed is:

1. A fuel evapotranspiration preventing device for internal combustion engines comprising:

a fuel tank having a main tank portion and a sub-tank portion;

return piping for returning excess fuel from an internal combustion engine to said main tank portion and said sub-tank portion;

a distributing valve disposed in said return piping for distributing said excess fuel to said main tank portion and said sub-tank portion;

operating condition detecting means for detecting an operating condition of said internal combustion engine; and a distributed volume controlling device that changes a volume of said excess fuel to be distributed by controlling said distributing valve according to results detected by said operating condition detecting means.

2. A fuel evapotranspiration preventing device for internal combustion engines according to claim 1, wherein said operating condition detecting means includes fuel temperature detecting means for detecting temperature of fuel in said sub-tank portion, and said distributed volume controlling device changes the volume of said excess fuel to be distributed by said distributing valve such that all of said excess fuel is returned to said sub-tank portion when the temperature of fuel in said sub-tank portion is lower than a given temperature near the boiling point of the fuel, and that said excess fuel is returned to said sub-tank portion and said main tank portion when said fuel temperature is higher than said given temperature.

3. A fuel evapotranspiration preventing device for internal combustion engines according to claim 2, wherein said distributed volume controlling device includes changing means for changing a volume ratio of fuel returned to said main tank portion, and said changing means increases said volume ratio until said fuel temperature becomes lower than said given temperature.

4. A fuel evapotranspiration preventing device for internal combustion engines according to claim 2, wherein said distributed volume controlling device includes changing means for changing a volume ratio of fuel returned to said main tank portion, and said changing means controls the volume ratio of fuel returned to said main tank portion and said sub-tank portion being equal when said fuel temperature is higher than said given temperature.

5. A fuel evapotranspiration preventing device for internal combustion engines according to claim 1, wherein said operating condition detecting means includes fuel temperature predicting means for predicting temperature of fuel in said sub-tank portion, and said distributed volume controlling device changes the volume of said excess fuel to be distributed by said distributing valve such that all of said excess fuel is returned to said sub-tank portion when the temperature of fuel in said sub-tank portion is lower than a given temperature near the boiling point of the fuel, and that said excess fuel is returned to said sub-tank portion and said main tank portion when said fuel temperature is higher than said given temperature.

6. A fuel evapotranspiration preventing device for internal combustion engines according to claim 5, further comprising intake pressure detecting means for detecting intake pressure; and engine speed detecting means for detecting engine speed;

wherein said fuel temperature predicting means predicts the temperature of fuel in said sub-tank based on said intake pressure of engine and said engine speed.

7. A fuel evapotranspiration preventing device for internal combustion engines according to claim 2, further comprising means for detecting a variation in the temperature of fuel in said sub-tank portion, wherein said distributed volume controlling device determines the volume ratio of fuel returned to said main tank portion and said sub-tank portion in accordance with said variation.

8. A fuel evapotranspiration preventing device for internal combustion engines according to claim 2, further comprising actuating means for actuating said distributing valve;

wherein opening of said distributing valve is controlled in accordance with the difference between the temperature of fuel in said sub-tank portion and said given temperature so as to change the volume ratio of fuel returned to said main tank portion linearly.

9. A fuel evapotranspiration preventing device for internal combustion engines according to claim 1, further comprising actuating means for actuating said distributing valve, which is operated by supplying electric current;

wherein opening of said distributing valve is controlled by changing duty ratio of said supplying electric current so as to change the volume ratio of fuel returned to said main tank portion.

10. A fuel evapotranspiration preventing device for internal combustion engines according to claim 1, wherein said distributing valve is a bimetal valve made of bimetal material.

11. A fuel evapotranspiration preventing device for internal combustion engines according to claim 1, wherein said distributing valve is disposed in a returning passage to said main tank portion.

12. A fuel evapotranspiration preventing device for internal combustion engines according to claim 1, wherein said distributing valve is composed of two valves, one is disposed in a returning passage to said main tank portion and another is disposed in a returning passage to said sub-tank portion.

13. A fuel evapotranspiration preventing device for internal combustion engines comprising:

a fuel tank having a main tank portion and a sub-tank portion;

a return piping for returning excess fuel from an internal combustion engine to said main tank portion and said sub-tank portion;

a fuel temperature detecting means for detecting temperature of the fuel in said sub-tank portion;

a distributing valve disposed in said return piping for distributing said excess fuel to said main tank portion and said sub-tank portion; and a distributed volume controlling device that changes the volume of said excess fuel to be distributed by controlling said distributing valve according to the temperature of the fuel in said sub-tank detected by said fuel temperature detecting means.

14. A fuel evapotranspiration preventing device for internal combustion engines according to claim 13, wherein said distributed volume controlling device changes the volume of said excess fuel to be distributed by said distributing valve such that all of said excess fuel is returned to said sub-tank portion when said temperature of fuel in said sub-tank portion detected by is lower than a given temperature near the boiling point of the fuel, and that said excess fuel is returned to said sub-tank portion and said main tank portion when said fuel temperature is higher than said given temperature.

15. A fuel evapotranspiration preventing device for internal combustion engines according to claim 14, wherein said distributed volume controlling device increases the volume ratio of fuel returned to said main tank portion until said fuel temperature becomes lower than said given temperature.

16. A fuel evapotranspiration preventing device for internal combustion engines according to claim 14, wherein said distributed volume controlling device controls the volume ratio of fuel returned to said main tank portion and said sub-tank portion being equal when said fuel temperature is higher than said given temperature.

17. A fuel evapotranspiration preventing device for internal combustion engines according to claim 13, wherein said fuel temperature detecting means includes fuel temperature predicting means for predicting temperature of fuel in said sub-tank portion, and said distributed volume controlling device changes the volume of said excess fuel to be distributed by said distributing valve such that all of said excess fuel is returned to said sub-tank portion when said fuel temperature detected by said fuel temperature detecting means is lower than a given temperature near the boiling point of the fuel, and that said excess fuel is returned to said sub-tank portion and said main tank portion when said fuel temperature detected by said fuel temperature detecting means is higher than said given temperature.

18. A fuel evapotranspiration preventing device for internal combustion engines according to claim 17, further comprising means for detecting a variation in said temperature of fuel in said sub-tank portion, wherein said distributed volume controlling device determines the volume ratio of fuel returned to said main tank portion and said sub-tank portion in accordance with said variation.

19. A fuel evapotranspiration preventing device for internal combustion engines according to claim 14, further comprising means for detecting a variation in the temperature of fuel in said sub-tank portion, wherein said distributed volume controlling device determines the volume ratio of fuel returned to said main tank portion and said sub-tank portion in accordance with said variation.

20. A fuel evapotranspiration preventing device for internal combustion engines according to claim 14, further comprising actuating means for actuating said distributing valve;

wherein opening of said distributing valve is controlled in accordance with the difference between the temperature of fuel in said sub-tank portion and said given temperature so as to change the volume ratio of fuel returned to said main tank portion linearly.

21. A fuel evapotranspiration preventing device for internal combustion engines according to claim 13, further comprising actuating means for actuating said distributing valve, which is operated by supplying electric current;

wherein opening of said distributing valve is controlled by changing duty ratio of said supplying electric current so as to change the volume ratio of fuel returned to said main tank portion.

22. A fuel evapotranspiration preventing device for internal combustion engines according to claim 13, wherein said distributing valve is a bimetal valve made of bimetal material.

23. A fuel evapotranspiration preventing device for internal combustion engines according to claim 13, wherein said distributing valve is composed of two valves, one is disposed in a returning passage to said main tank portion and another is disposed in a returning passage to said sub-tank portion.

* * * * *